US005120149A

United States Patent [19]

Smith

[11] Patent Number: 5,120,149

[45] Date of Patent: Jun. 9, 1992

[54] CONVERTIBLE RING BINDER INCORPORATING EXCHANGEABLE COVERS AND RING MEANS

[76] Inventor: Oliver F. Smith, 5084 Plaza Corona, Santa Clara, Calif. 95054

[21] Appl. No.: 601,387

[22] Filed: Oct. 23, 1990

[51] Int. Cl.[5] ..... B42F 13/16; B42F 13/00

[52] U.S. Cl. ..... 402/75; 281/29; 281/36; 281/37; 402/74

[58] Field of Search ..... 281/29, 36, 37; 402/75, 402/73, 74

[56] References Cited

U.S. PATENT DOCUMENTS 1,191,798 7/1916 Labarre ..... 402/74
1,978,383 10/1934 Lundeen et al. ..... 402/74
4,444,418 4/1984 Goldstein ..... 402/75
4,681,474 7/1987 Wiberg ..... 402/75

FOREIGN PATENT DOCUMENTS 1195360 10/1985 Canada ..... 281/29

*Primary Examiner*—Paul A. Bell
*Attorney, Agent, or Firm*—John J. Leavitt

[57] ABSTRACT

A convertible ring binder incorporates front and back covers that are detachable one from the other to enable exchange of the covers for new or different covers. Hook and loop material is utilized to effect detachable attachment of the covers. In another aspect, the ring structure utilized to store paper in the binder is detachably secured to the spine of a loose-leaf ring binder.

8 Claims, 1 Drawing Sheet

CONVERTIBLE RING BINDER INCORPORATING EXCHANGEABLE COVERS AND RING MEANS

BACKGROUND OF THE INVENTION

1. This invention relates to ring binders of the type used to store sheets of paper in a manner that they may be inserted and removed from the ring binder, and particularly to such a ring binder that incorporates exchangeable covers and ring structure.

2. Description of the Prior Art.

A preliminary patentability and novelty search in connection with this invention has revealed the existence of the following U.S. Pat. Nos.: 1,079,418; 1,191,798; 3,245,411; and 4,239,411.

U.S. Pat. No. 1,078,418 is directed to a book holder of the type for holding a quantity of loose pages, such as in a binder. However, in this structure, the loose pages are held in place by posts that telescope into tubular sockets, in much the same way that heavy bookkeeping books are constructed. Obviously, this construction is very different from the structure described and claimed herein.

U.S. Pat. No. 1,191,798 is also directed to a binder of the type utilizing posts to support loose pages between two covers, the covers also being held together by the posts. Again, this structure is substantially different from the structure described and claimed herein.

U.S. Pat. No. 3,245,411 discloses a structure that is designed especially for the support of samples of carpets, fabrics, or wall paper, to facilitate a sales person carrying a number of such samples to a perspective customer. In this structure, the spine of the holder is formed by the overlapping members, which are held together in overlapping relationship by a channel member so that they do not pull apart when the handle is grasped and lifted. The samples are held to this structure by threaded posts that telescope into appropriate tubes. As with the preceding patents, this structure is very different from the structure described and claimed herein.

U.S. Pat. No. 4,239,411 is directed to a binder construction for loose leaf papers, and utilizes the "prong" structure common in binders of the type that compete with conventional ring binders. In this binder, the L-shaped members to which the prongs are attached, retain the papers in the binder, and the prongs are held in close position by a flexible strap which is provided with "Velcro" strips to attach the free ends of the flexible strap. It requires only a cursory examination of this structure to realize that it is substantially different from the structure described and claimed herein.

Loose-leaf ring binders of the type used by school children to store their school papers, and used in businesses to store readily accessible business records, are preferably simple in their construction and simple to operate so that they may be purchased for a relatively low cost. This is particularly true with loose-leaf ring binders utilized by children for school work since such binders are commonly substantially abused and must frequently be replaced. Additionally, again referring to loose-leaf ring binders for young people, particularly school children, and especially children from the junior high to the senior high school level, it is common practice for these school children to "customize" their binder covers with art work that may include adhesively secured pin-ups, photographs of friends, and other types of indicia which a student may wish to exchange with another student. Accordingly, an important object of the present invention is the provision of a relatively simple loose-leaf ring binder construction that enables the exchange of one or both covers from one ring binder to another.

Through use of a ring binder over time, the covers frequently become soiled or damaged to the point that they must be repaired or replaced. Replacement of conventional binders requires the replacement of the entire binder including the ring structure. Accordingly, another object of the present invention is the provision of a loose-leaf ring binder that incorporates a ring structure that is readily detachable from the front and back covers associated with it, and which is readily re-attachable to different front and back and back covers.

The invention possesses other objects and advantages, some of which, with the foregoing, will be apparent from the following description and the drawings. However, it is not intended that the invention be limited to the embodiment illustrated and described since it may be embodied in various forms within the scope of the appended claims.

SUMMARY OF THE INVENTION

In terms of broad inclusion, the convertible ring binder of the invention in one aspect comprises separate and individual front and back covers, each having a spine portion pivotally attached to one edge thereof, with the spine members incorporating means for detachably securing one spine to the other in overlapping superimposed juxtaposed relationship so that both front and back cover may pivot in relation to the spine portion. Ring means are mounted on the spine portion for retention of one or more sheets of paper to be enclosed within the binder. In another aspect of the invention, the spine portion of the binder is equipped with a detachable ring structure so that the entire ring structure including whatever papers are attached thereto may be separated from the front and back covers and the spine portion associated therewith and transferred to a different or new set of front and back covers joined by a spine portion.

DESCRIPTION OF THE PREFERRED EMBODIMENT

Figure 1:
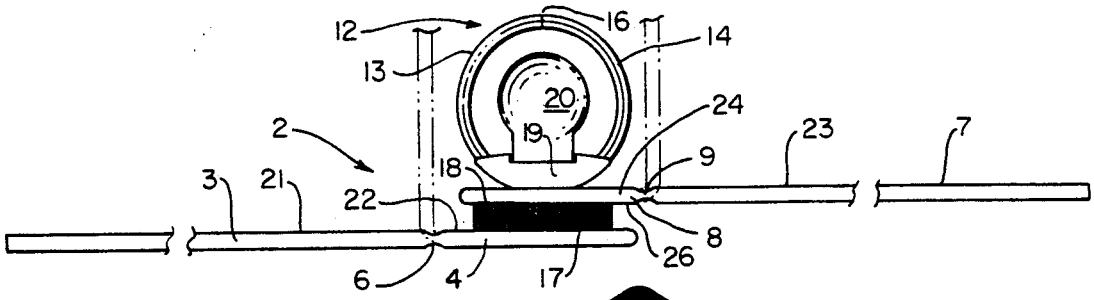
FIG. 1 is an edge elevational view illustrating the front cover, the back cover and the ring structure for holding a number of loose leaf papers bound in the ring binder, shown in assembled open form. Portions of the front and back cover have been broken away to reduce the size of the view.
Figure 2:
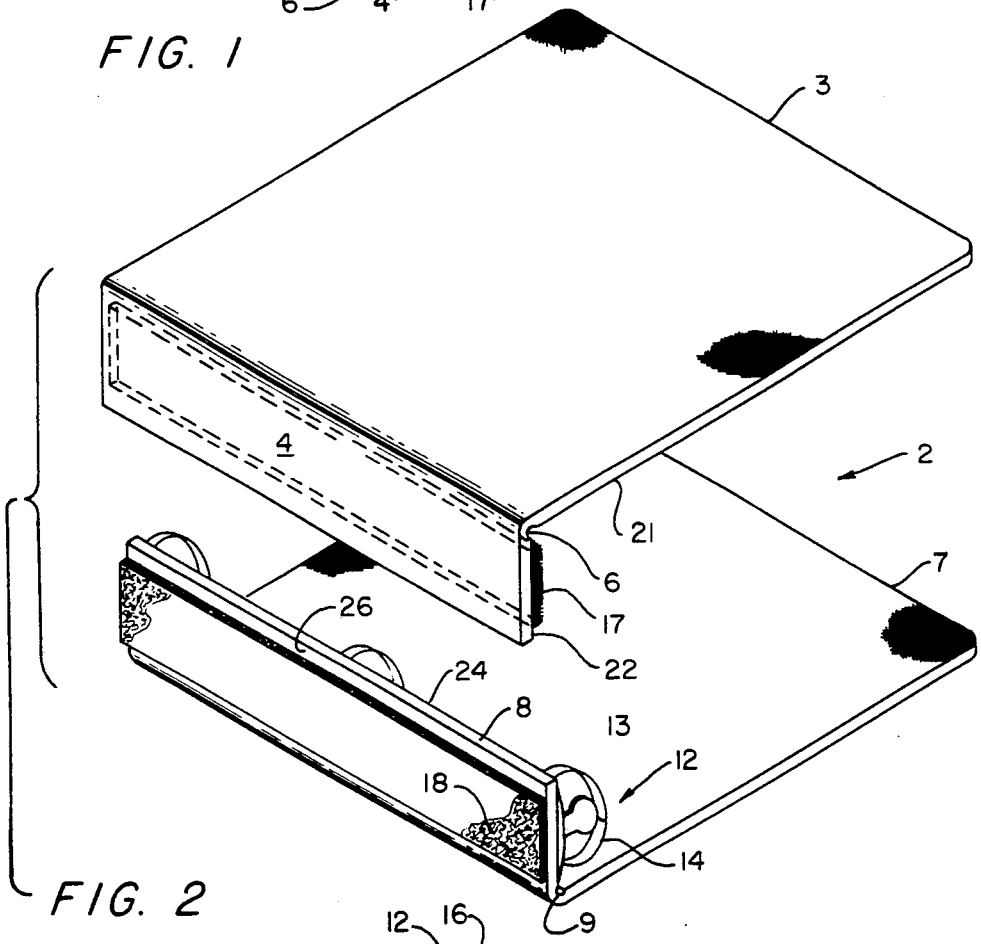
FIG. 2 is a perspective view of the front and back cover and spine portions associated therewith shown in exploded form.

In terms of greater detail, and referring to the drawings, particularly FIGS. 1 and 2, it will there be seen that the convertible ring binder of the invention is designated generally by the numeral 2 and includes a front cover 3 having a spine portion 4 associated therewith along one edge thereof, and a pivotal union 6 by which the cover 3 is joined to the spine portion 4.

In like manner, the convertible ring binder includes a back cover designated generally by the numeral 7 and including a spine portion 8 joined to the back cover by a pivotal union section 9 that joins one edge of the spine portion 8 to the associated edge of the back cover 7. Mounted on the spine portion 8 associated with the back cover, is a ring means designated generally by the numeral 12 and including split ring portions 13 and 14 that are separable at 16 and terminate within a metal housing 19 that encloses appropriate spring means (not shown) for resiliently retaining the split rings 13 and 14 either closed or open. This structure is conventional and is therefore not illustrated. Tab means 20 are provided to assist in opening or closing the rings and locking them in a closed position as is common with such loose-leaf ring binders.

Conventional loose-leaf ring binders commonly utilize a single spine portion that integrally connect the front and back covers and on which the ring means 12 is permanently mounted. Referring to FIG. 1, it will be seen that the spine portion 4 associated with the front cover 3 is provided with a layer of hook members 17 fixed to the spine portion 4, and adapted to interact with an opposed layer of loops 18 with which the hook members 17 are adapted to detachably interact. This hook and loop structure may be of the type sold under the trademark "Velcro", or it may be of any other suitable means for detachably securing the spine portion 4 to the spine portion 8 for selective engagement and disengagement of these two spine portions.

It should be noted that the front cover 3 is provided with an inside surface 21 that is coextensive with the inside surface 22 of the spine portion 4, the pivotal union 6 between these two surfaces constituting an elongated score line or groove extending across the material of the front cover so as provide a thinned-down section at 6 that is readily flexible to permit the front cover to be raised into its operative position as illustrated in broken lines.

The back cover 7, on the other hand, is provided with an inside surface 23 that is coextensive with the inside surface 24 of the spine portion 8, on which inside surface is mounted the ring structure designated generally by the numeral 12, as illustrated. The spine portion 8 is also provided with an outer surface 26 to which the layer of loop material 18 is secured for interaction with the hook material 17 securely fastened to the inside surface 22 of the spine portion 4. It will thus be seen that all that is required to assemble the binder for use is that the layers of hook and loop material be aligned and then pressed together by the application of opposing forces perpendicularly to the spine portions 4 and 8. When so interengaged, the spine portions 4 and 8 are securely held together against relative transverse movement with relation to each other while enabling separation of the spine portions 4 and 8 by a tensive force applied perpendicularly to the spine portions 4 and 8 in a direction to separate the spine portions.

Thus, this convertibility of the loose-leaf binder enables a student, for instance, to exchange the cover from his binder for the cover of a friend's binder in much the same way that students frequently exchange other personal objects with each other as a sign of affection for each other.

Figure 3:
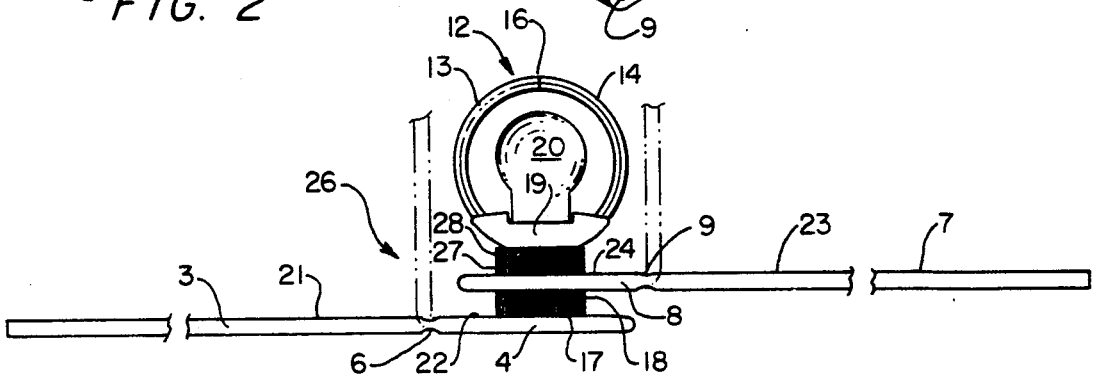
FIG. 3 is an edge elevational view similar to FIG. 1 of a second embodiment that incorporates the structure of FIG. 1 but also illustrates the ring structure as being detachably secured to the associated spine portion of the back cover. Portions of the front and back cover have been broken away to reduce the size of the view.

Referring to the embodiment of the invention illustrated in FIG. 3, it will be seen that the structure illustrated in FIGS. 1 and 2 is incorporated in the structure illustrated in FIG. 3, and accordingly, the same reference numbers have been applied to identical structures found in the two embodiments.

The embodiment illustrated in FIG. 3 is designated generally by the numeral 26 and differs from the embodiment illustrated in FIGS. 1 and 2 in that the ring structure designated generally by the numeral 12 is secured to the inside surface 24 of the spine portion 8 of the back cover 7 by a layer of hook material 27 fixed to the inside surface 24 of the spine portion 8, so that it interacts with a layer of loop material 28 secured to the housing member 19 of the ring structure 12. In this manner, when so desired, the owner of the loose-leaf ring binder may not only exchange the front or back cover of his binder for complementary front and back covers secured from a friend, but may also exchange the ring structure apart from the front and back covers. This facility is an advantage because if the front and back covers have been essentially destroyed through use, or have become mutilated through use, the entire contents of the binder may be switched or placed in a new ring binder without the inconvenience of transferring the papers from one ring structure to another.

Having thus described the invention, what is believed to be new and novel and sought to be protected by letters patent of the United States is as follows.

I claim:

1. A convertible ring binder of the type used to store sheets of paper, comprising:

a) a front cover having a spine portion pivotally mounted thereon along one edge thereof;

b) a back cover having a spine portion pivotally mounted thereon along one edge thereof;

c) ring means mounted on one of said spine portions manipulable to engage or release one or more sheets of paper; and d) means on said spine portions selectively engageable and disengageable to operatively associate said spine portions and said front and back covers to form a composite binder selectively convertible by the substitution of one cover for another;

e) said means on said spine portion engageable and disengageable to cooperatively associate said spine portions comprising hook and loop members mounted on said spine portions.

2. A convertible ring binder of the type used to store sheets of paper, comprising:

a) a front cover having a spine portion pivotally mounted thereof along one edge thereof;

b) a back cover having a spine portion pivotally mounted thereon along one edge thereof;

c) ring means mounted on one of said spine portions manipulable to engage or release one or more sheet of paper; and d) means on said spine portions selectively engageable and disengageable to operatively associate said spine portions and said front and back covers to form a composite binder selectively convertible by the substitution of one cover for another;

e) said front and back covers and the spine portions associated therewith having inside and outside surfaces, said ring means mounted on one of said spine portions manipulable to engage or release said paper and being mounted on the inside surface of the spine portion associated with said back cover, said means on said spines portions selectively engageable and disengageable to operatively associate said spine portions and said front and back covers being mounted on the inside surface of the spine portion associated with the front cover and the outside surface of the spine portion associated with the back cover, whereby when said means are engaged said spine portions lie engaged in parallel juxtaposition and said front cover may be opened to give access to said papers;

f) said means on said spine portions engageable and disengageable to cooperatively associate said spine portions comprising hook and loop members mounted on said spine portions.

3. A convertible binder of the type used to store sheets of paper, comprising:

a) a front cover having a spine portion pivotally mounted thereon along one edge thereof;

b) a back cover having a spine portion pivotally mounted thereon along one edge thereof;

c) a plurality of split ring portions mounted in longitudinally spaced relation along one of said spine portions and manipulable to retain or enable release of one or more sheets of paper; and d) means on said spine portions selectively engageable and disengageable to operatively associate said spine portions and said front and back covers to form a composite binder selectively convertible by the substitution of one cover for another;

e) said means on said spine portions engageable and disengageable to operatively associate said spine portions comprising interengageable fastener elements that are engageable by the application of opposing forces perpendicularly to the spine portions and separable by application of a tensive force applied perpendicularly to the spine positions in a direction to separate the spine portions.

4. The convertible binder according to claim 3, wherein said split ring portions mounted on one of said spine portions manipulable to retain or release said paper is mounted on the spine portion associated with said back cover.

5. The convertible binder according to claim 4, wherein said split ring portions mounted on one of said spine portions manipulable to retain or release said paper is detachably mounted on the spine portion associated with said back cover.

6. The convertible binder according to claim 3, wherein said front and back covers and the spine portions associated therewith have inside and outside surfaces, said split ring portions mounted on one of said spine portions manipulable to retain or release said paper are mounted on the inside surface of the spine portion associated with said back cover, and said means on said spine portions selectively engageable and disengageable to operatively associate said spine portions and said front and back covers are mounted on the inside surface of the spine portion associated with the front cover and the outside surface of the spine portion associated with the back cover, whereby when said means are engaged said spine portions lie engaged in parallel juxtaposition and said front cover may be opened to give access to said papers.

7. The convertible binder according to claim 6, wherein said split ring portions mounted on said spine portion associated with said back cover to retain or release said paper are detachably mounted on the inside surface of the spine portion, and selectively interengageable and disengageable hook and loop means mounted on said split ring portions and on the inside surface of said spine portion associated with said back cover to detachably retain said split ring portions thereon.

8. The convertible binder according to claim 3, wherein said split ring portions mounted on one of said spine portions manipulable to retain or release said paper is detachably secured to the associated spine portion.

* * * * *